US006584955B1

(12) United States Patent
Ketterer et al.

(10) Patent No.: US 6,584,955 B1
(45) Date of Patent: Jul. 1, 2003

(54) METHOD AND DEVICE FOR PHASE RECOGNITION IN A 4-STROKE OTTO ENGINE WITH ION FLOW MEASUREMENT

(75) Inventors: Markus Ketterer, Stuttgart (DE); Klaus-Juergen Wald, Stuttgart (DE); Achim Guenther, Stuttgart (DE); Juergen Foerster, Ingersheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/673,876

(22) PCT Filed: Apr. 16, 1999

(86) PCT No.: PCT/DE99/01147

§ 371 (c)(1),
(2), (4) Date: Dec. 22, 2000

(87) PCT Pub. No.: WO99/54622

PCT Pub. Date: Oct. 28, 1999

(30) Foreign Application Priority Data

Apr. 20, 1998 (DE) ..... 198 17 447

(51) Int. Cl.[7] ..... F02P 17/12
(52) U.S. Cl. ..... 123/406.27; 123/406.26
(58) Field of Search ..... 123/406.27, 406.26, 123/406.11, 406.17

(56) References Cited

U.S. PATENT DOCUMENTS

| | | | | |
|---|---|---|---|---|
| 5,067,462 A | | 11/1991 | Iwata | |
| 5,425,339 A | | 6/1995 | Fukui | |
| 5,945,828 A | * | 8/1999 | Katogi et al. | 123/406.27 |
| 5,970,952 A | * | 10/1999 | Mogi et al. | 123/406.27 |
| 6,091,244 A | * | 7/2000 | Rottler | 123/406.27 |
| 6,123,057 A | * | 9/2000 | Goras et al. | 123/406.2 |

FOREIGN PATENT DOCUMENTS

| | | |
|---|---|---|
| DE | 196 08 526 | 9/1997 |
| EP | 0 704 621 | 4/1996 |
| EP | 933 525 | 8/1999 |

* cited by examiner

*Primary Examiner*—John Kwon
(74) *Attorney, Agent, or Firm*—Kenyon & Kenyon

(57) ABSTRACT

A device and a method for detecting phase in four-stroke engines, in which an electronic control unit (ECU) detects a spark current as a measuring signal and determines whether ignition occurred for ascertaining the compression cycles of the cylinders, whereby the electronic control unit is able to cause the injection to be performed in a correct phase relation.

12 Claims, 3 Drawing Sheets

METHOD AND DEVICE FOR PHASE RECOGNITION IN A 4-STROKE OTTO ENGINE WITH ION FLOW MEASUREMENT

TECHNICAL OBJECTIVE

FIELD OF THE INVENTION

The present invention concerns internal combustion engines that are controlled in open and closed loop by an ECU (electronic control unt), and if the injectors for engines are controlled electrically by the ECU, then it is necessary to determine the phase angle when starting the internal combustion engine. Phase detection for a four-stroke Otto spark ignition engine indicates whether the piston is in the compression cycle or in the exhaust cycle during the upward movement.

BACKGROUND INFORMATION

In known systems, this is achieved, for example, by an additional transmitter wheel on the camshaft, or by discharge (outflow) detection.

SUMMARY OF THE INVENTION

An exemplary method of the present invention is directed to a method used for detecting phase with the aid of an ionic-current measuring circuit.

DESCRIPTION

Figure 1:
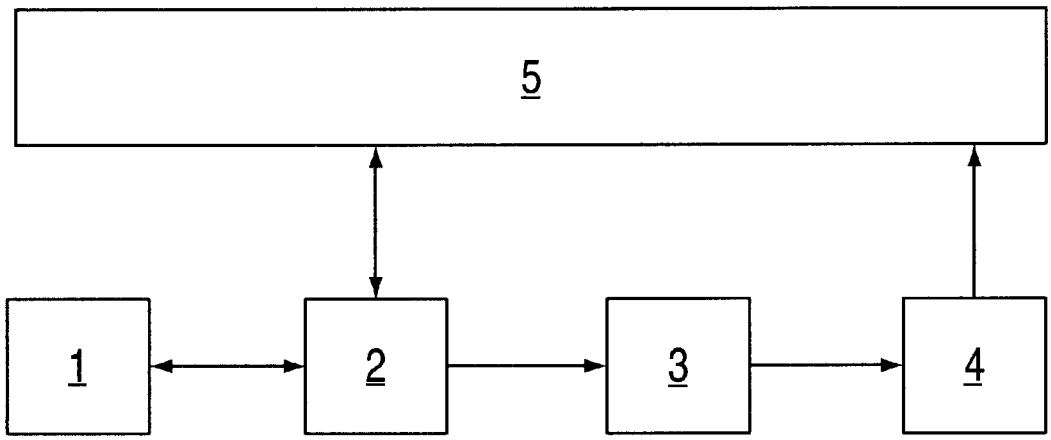
FIG. 1 shows an overview of the entire system, including a cylinder, an ignition system, an arrangement or structure for measuring ionic current, an arrangement or structure for forming features and an electronic control unit (ECU).

The present method is presented in FIG. 1 on the basis of an exemplary embodiment. It utilizes arrangement or structure 3 for measuring ionic current, in that the ignition, system 2, is observed with the aid of these arrangements the ignition system 2, may by used to start combustion process 1.

If an ignition spark develops at the spark plug, and if ionic current is measured at this spark plug during this time, then the spark current can be verified with the aid of arrangement or structure 3. The detection of an ignition spark can be utilized for determining the phase.

According to Paschen's law, the greater the pressure between the electrodes, the higher the ignition voltage. If the engine is turned by the starter, then the gas in the combustion chamber is compressed after each 720° of crankshaft revolution. This pressure rise in the compressed gas, into which no fuel has yet been injected, leads to an increased ignition voltage. The difference between high and low ignition voltage can be determined by the ignition energy. If only so much energy is made available to the system that it suffices for ignition in the ranges of low pressure, but not in those of high pressure, then a distinguishing feature can be formed by analyzing the spark current.

If no ignition spark has sparked over, then only the primary and secondary leakage capacitance will be charged, and in the next step, the energy is fed back into the vehicle electrical system via the free-wheeling diode D located in the igniter or externally. A very brief ionic current will be measured which is simulated by the spark current.

The correct energy level is determined as follows:

Even before the starter begins with the rotation, the interrupting current, provided with sufficient signal-to-noise ratio, is determined by a series of ignition sparks, so that an ignition is reliably effected. This adjustment can possibly include 10 iterations. It is possible that several cylinders will already be in the compressed state. In this case, the necessary energy level is incorrectly determined. However, at least half the cylinders will be in a sufficiently non-compressed state, so that even in this case, sufficient redundancy is still provided.

Phase detection and ignition control are carried out continuously at all cylinders with the aid of the ionic-current measuring circuit. Following output ignition (following each output spark), if necessary, the ascertained characteristic value is acquired by the ECU and classified as successful (effected) or unsuccessful (not effected) ignition. If misfiring is detected, given sufficient ignition repetition frequency, a plurality of ignitions can be evaluated within the time period that a piston passes the compression top-dead-center, so that reliable information is obtained with respect to the cylinder distant by 360° of crankshaft revolution. That is to say, in the case of one cylinder, there is no ignition, and in the case of the cylinder distant by 360° of crankshaft revolution, the ignition spark continues. From this point on, the phase is known.

At the latest after one revolution, after running past the reference mark on the crankshaft transmitting wheel, it is possible to begin with injection at the correct cylinder. In this context, it is imperative that the interrupting current which is equal to the energy introduced into the coil) be maintained constant. In some instances, the battery voltage must be determined by the ECU and the dwell period/dwell angle be corrected.

Using an exemplary inductive ignition system, "feature" formation occurs as follows:

At any rate, the ionic-current measuring device can determine a part of the spark current, and is generally fully driven in this manner. If, after the energy level has been adjusted, an ignition attempt is carried out, the ionic current is integrated during the period of an ignition spark, the result is detected by a Sample & Hold and is made available to the ECU.

Another exemplary embodiment for feature acquisition may be implemented in that the measured signal is low-pass filtered and observed with a peak-value acquisition device. The peak value is supplied to the ECU and is subsequently compared to a threshold.

Figure 2:
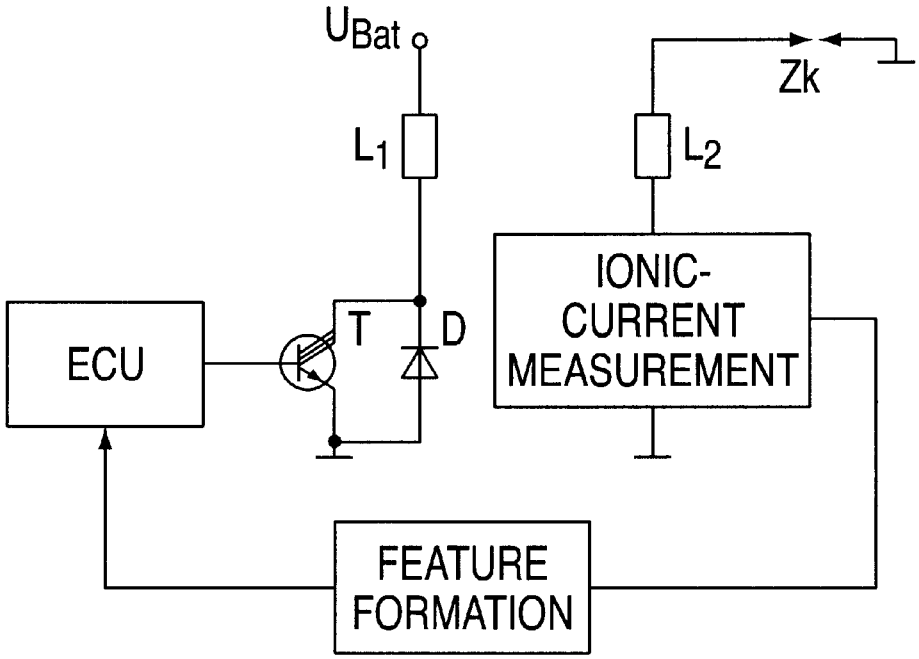
FIG. 2 shows an exemplary embodiment according to the present invention.
Figure 3:
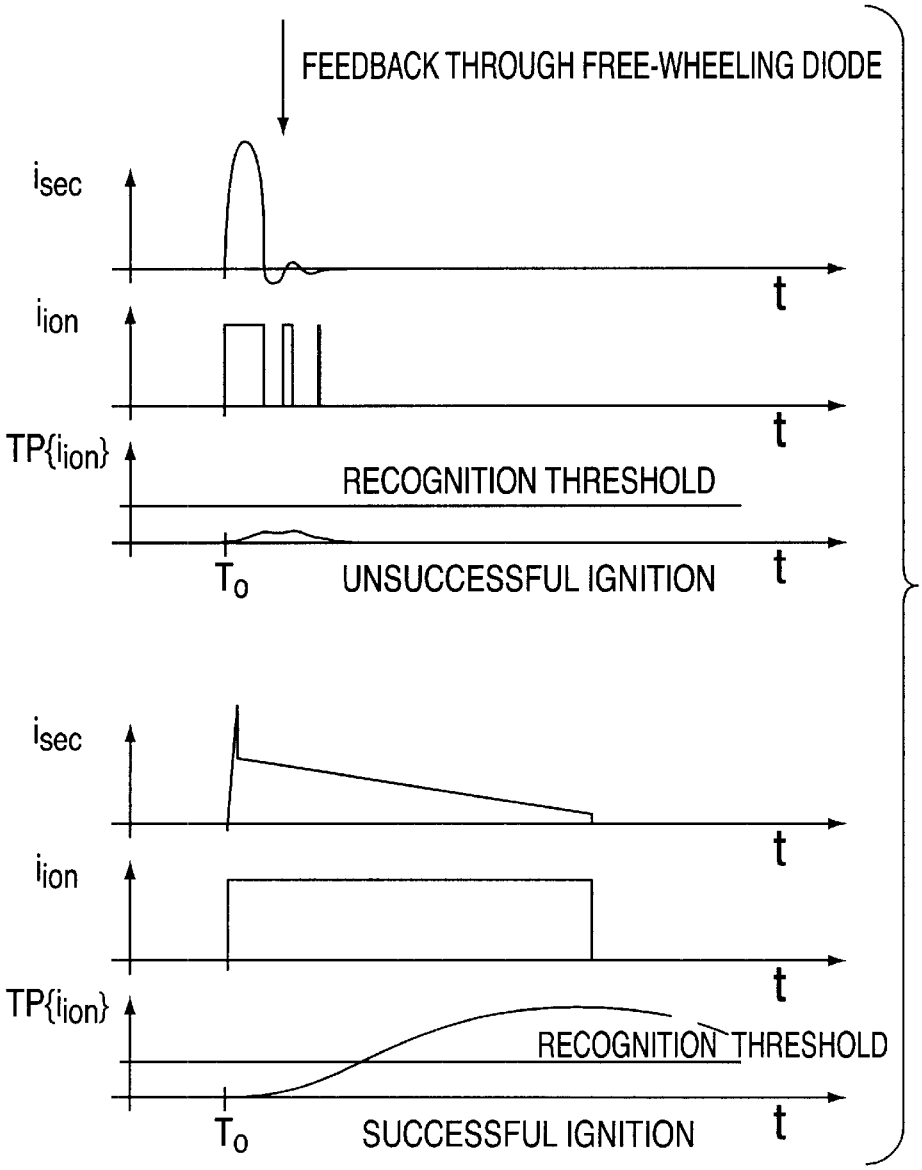
FIG. 3 shows exemplary signal shapes.

FIG. 3 shows, by way of example, the signals occurring at the inductive ignition system. Differentiation is made between "unsuccessful (not effected) ignition" and"successful (effected) ignition". Shown are: the secondary current which flows in $L_2$ (see FIG. 2); the ionic current which is measured by the ionic-current measuring device and, illustratively, the low-pass signal of the measured ionic current which is intended to show the feature formation.

It is assumed that the manner in which an inductive ignition system functions is sufficiently familiar. First of all, the ignition energy is introduced via the primary side into the ignition coil by closing the transistor. At point of time To, ignition transistor T is switched to highly-resistive and the energy in the coil now drives a current in the primary winding and secondary winding. The current in the secondary winding is designated as $i_{sec}$, and can be seen in each case in the first diagram.

For unsuccessful ignition in which the energy in the ignition coil does not suffice for the ignition spark to spark over, the entire arrangement behaves like an LC oscillating circuit having one coil in the primary side and secondary side, respectively. The capacitances are produced in each case by leakage and component capacitances. On the secondary side, they are coil capacitance, cable capacitance and spark plug capacitance. If half the oscillation is past, the current in the primary side and secondary side becomes negative. At this point, on the primary side, free-wheeling diode D begins to conduct and feeds the remainder of the energy back into the battery. The energy is withdrawn in this way on the secondary side as well, and the current flow is brought quickly to a standstill. Since the ionic currents are very small, the signal level of the ionic-current measurement $i_{ion}$ is immediately driven (modulated) to a maximum. If ionic-current signal $i_{ion}$ is low-pass filtered $TP\{i_{ion}\}$, then only a low signal level is achieved.

Successful ignition, in which there is a spaarkover before the leakage capacitances have been charged with the entire energy, the triangular spark current, typical for an inductive ignition system, flows in the secondary side. This, in turn, is sufficient to fully modulate (drive) the level of the ionic-current measuring device. Low-pass filtered ionic-current signal $TP\{i_{ion}\}$ achieves a perceptibly higher level then the signal in the case of an unsuccessful ignition.

The ECU can easily distinguish the two cases.

Figure 4:
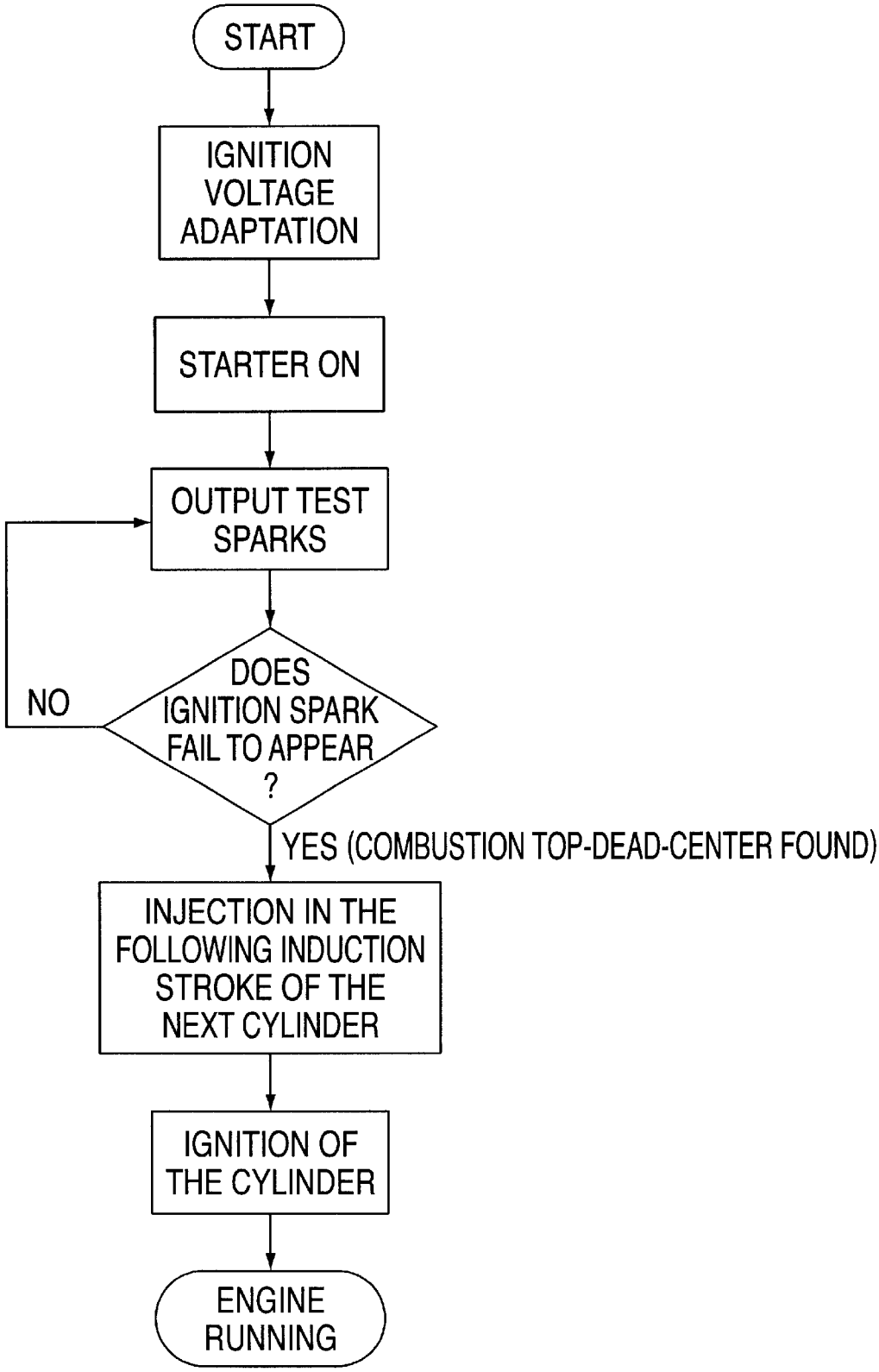
FIG. 4 shows a flow chart for an exemplary method according to the present invention.

The exemplary method of the flow chart shown in a FIG. 4 is applicable for all or appropriately selected cylinders which are to be observed for phase detection. For an engine having a high number of cylinders, all the cylinders will probably not be necessary for detecting phase. This exemplary flow chart is intended to provide a simpler view of the exemplary method.

Thus, the exemplary embodiments involve measuring ionic-current for observing ignition sparks and the phase detection derived therefrom.

If ionic-current measurement is provided on a vehicle it is believed that phase detection can be installed by a small additional technical expenditure.

Since the exemplary method is supported by already existing resources, of is belied to be extremely cost-effective.

What is claimed is:

1. A device for detecting a phase angle for an internal combustion engine having a plurality of cylinders, each cylinder having at least one spark plug for triggering an ignition spark, the device comprising:

an ionic-current measuring device for measuring an ionic current and for providing a signal;

an electronic control unit for determining whether the ignition spark occurred in at least one cylinder of the plurality of the cylinders based on the signal from the ionic-current measuring device;

an arrangement for adjusting an energy of the ignition spark in the at least one cylinder so that the ignition spark occurs in response to a low internal pressure in the at least one cylinder and so that the ignition spark does not occur in response to a high internal pressure in the at least one cylinder; and an arrangement for determining the phase angle in the at least one cylinder based on observing at least one successful occurrence of the ignition spark and at least one unsuccessful occurrence of the ignition spark.

2. The device of claim 1, wherein the ionic-current measuring device integrates the ionic current during a period of the ignition spark.

3. The device of claim 1, wherein the ionic-current measuring device detects a peak value of a low-pass filtered part of a current associated with the ignition spark.

4. The device of claim 3, wherein the electronic control unit compares the peak value to a threshold value.

5. The device of claim 1, wherein the arrangement for determining the phase angle in the at least one cylinder determines the phase angle based on observing at least one successful ignition spark and at least one synchronously unsuccessful ignition spark in two cylinders of the plurality of cylinders, the two cylinders being distant by 360° of a crankshaft revolution.

6. The device of claim 1, further comprising an arrangement for enabling a crankshaft revolution to be performed for conveying combustible residual gas out of the at least one cylinder.

7. A method for detecting a phase angle for an internal combustion engine having a plurality of cylinders, each cylinder having at least one spark plug for triggering an ignition spark, the method comprising the steps of:

measuring an ionic current with an ionic-current measuring device and providing a signal;

determining whether the ignition spark occurs in at least one cylinder of the plurality of cylinders based on the signal from the ionic-current measuring device;

adjusting an energy of the ignition spark so that an occurrence of the ignition spark is a function of an internal pressure in the at least one cylinder; and determining the phase angle of the at least one cylinder based on observing at least one successful ignition spark and at least one unsuccessful ignition spark.

8. The method of claim 7, wherein the ionic-current measuring device detects the ionic current during a period of the ignition spark.

9. The method of claim 7, wherein the ionic-current measuring device detects a peak value of a low-pass filtered part of a spark current.

10. The method of claim 9, wherein the electronic control unit compares the peak value to a threshold value.

11. The method of claim 7, wherein the phase angle of the at least one cylinder is determined based on observing at least one successful ignition spark and at least one synchronously unsuccessful ignition spark in two cylinders of the plurality of cylinders, the two cylinders being distant by 360° of a crankshaft revolution.

12. The method of claim 7, wherein a crankshaft revolution is performed prior to performing the step of determining the phase angle so that combustible residual gas is conveyed out of the at least one cylinder.

* * * * *

UNITED STATES PATENT AND TRADEMARK OFFICE

CERTIFICATE OF CORRECTION

PATENT NO. : 6,584,955 B1
DATED : July 1, 2003
INVENTOR(S) : Markus Ketterer et al.

It is certified that error appears in the above-identified patent and that said Letters Patent is hereby corrected as shown below:

Column 1,
Line 5, delete “TECHNICAL OBJECTIVE”
Line 41, change “DESCRIPTION” to -- DETAILED DESCRIPTION --
Line 45, change “ignition, system 2” to -- ignition system 2 --.
Line 46, change “arrangements the” to -- arrangements. The --.
Line 47, change “2,” to -- 2 --.

Column 2,
Line 35, change “which is equal” to -- (which is equal --.

Column 3,
Line 4, change “ignition in” to -- ignition, in --.
Line 22, change “successful ignition, in which there is a spaarkover...” to -- For sucessful ignition, in which there is a sparkover... --.
Line 32, change “a FIG. 4” to -- FIG.4 --.
Line 46, change “belied” to -- believed --.

Signed and Sealed this

Eighteenth Day of January, 2005

JON W. DUDAS
*Director of the United States Patent and Trademark Office*